US005300981A

United States Patent [19]

Shioya

[11] Patent Number: 5,300,981

[45] Date of Patent: Apr. 5, 1994

[54] ELECTROPHOTOGRAPHIC PRINTING APPARATUS WITH FIRE PREVENTION

[75] Inventor: Setsuo Shioya, Shizuoka, Japan

[73] Assignee: Tokyo Electric Co., Ltd., Tokyo, Japan

[21] Appl. No.: 734,514

[22] Filed: Jul. 23, 1991

[30] Foreign Application Priority Data

Jul. 27, 1990 [JP] Japan ..... 2-197853

[51] Int. Cl.[5] ..... G03G 21/00

[52] U.S. Cl. ..... 355/206; 355/282; 355/285

[58] Field of Search ..... 355/205, 206, 209, 282, 355/285, 290, 295, 316; 219/216

[56] References Cited

U.S. PATENT DOCUMENTS

| | | | |
|---|---|---|---|
| 3,586,450 | 6/1971 | Hosey et al. | 355/206 |
| 3,705,289 | 12/1972 | Szostak et al. | 219/216 |
| 3,748,088 | 7/1973 | Mooney et al. | 432/46 |
| 3,791,732 | 2/1974 | Mihalik et al. | 355/285 |
| 3,804,516 | 4/1974 | De Mott | 355/203 |
| 4,118,178 | 10/1978 | Calvi et al. | 432/35 |
| 4,168,903 | 9/1979 | Tolmie | 355/285 |
| 4,402,594 | 9/1983 | Pelda et al. | 355/206 |
| 4,569,585 | 2/1986 | Masuda | 355/206 |
| 4,613,227 | 9/1986 | Honjo | 355/311 |
| 4,740,671 | 4/1988 | Kuroda | 217/492 |
| 4,956,651 | 9/1990 | Emori | 355/316 X |

FOREIGN PATENT DOCUMENTS 0345018 12/1989 European Pat. Off. .

OTHER PUBLICATIONS

Patent Abstracts of Japan; vol. 5, No. 92, p. 66; Jun. 1981; & JP A-56 038 071 (Canon).

IBM Technical Disclosure Bulletin, vol. 21, No. 2, Jul. 1978, pp. 481-482 "Copier Fuser Controls".

*Primary Examiner*—Leo P. Picard

*Assistant Examiner*—Christopher Horgan

*Attorney, Agent, or Firm*—Frishauf, Holtz, Goodman & Woodward

[57] ABSTRACT

An electrophotographic printing apparatus includes a paper conveyor path, a photosensitive drum arranged on the paper conveyor path, a conveyor unit for conveying paper along the conveyor path, an image forming unit for forming an electrostatic latent image on the photosensitive drum, developing the electrostatic latent image by depositing a developer on the electrostatic latent image, and transferring the developer image onto paper, and a fixing unit, arranged on the paper conveyor path, for fixing the transferred image on the paper by heat and pressure. The printing apparatus further comprises a control circuit for detecting overheating of the fixing unit and commanding the conveyor unit to stop conveyance of paper after confirming that no paper is present in the fixing unit when the fixing unit is detected to be overheating.

6 Claims, 3 Drawing Sheets

ELECTROPHOTOGRAPHIC PRINTING APPARATUS WITH FIRE PREVENTION

BACKGROUND OF THE INVENTION

1. Field of the Invention

The present invention relates to an eleotrophotographic printing apparatus for thermally fixing a transferred image on paper.

2. Description of the Related Art

A laser printer is a well known electrophotographic printing apparatus. This type of printer selectively exposes a charged photosensitive body by means of a laser beam to form an electrostatic latent image thereon, deposits toner to develop the formed electrostatic latent image, and transfers the toner image onto a sheet of paper. After transfer, the paper is conveyed to a fixing unit, and the toner image is fixed on the paper by heat and pressure applied thereto while passing through heat and pressure rollers of the fixing unit.

The controller of the laser printer generally measures the fixing temperature by means of a temperature sensor, and controls the power supplied from a heater driver to a heater of the heat roller in accordance with the measured temperature to maintain the fixing temperature at a predetermined level. When overheating of the fixing unit is detected, the controller cuts off the power supply to the heater and stops conveyance of paper.

Overheating is sometimes occurs as a result of failure of a power transistor provided in the heater driver. If such a causes the power transistor to stay ON, the power supply to the heater cannot be cut off even when overheating is detected. If paper is passing through the fixing at the time overheating is detected, the paper will be intensely heated in the fixing unit and may catch fire. Even if the paper does not catch fire, it may be burned to a degree where it adheres to the heat rollers and the pressure rollers. In such a case, not only must the heater driver be repaired, but the burned paper must also be removed from the heat rollers and the pressure rollers in order that they can function normally, resulting in time-consuming and expensive repairs.

SUMMARY OF THE INVENTION

It is an object of the present invention to provide an electrophotographic printing apparatus having improved safety features and which can be easily repaired in the event that a fixing unit causes overheating to occur.

The object of present invention is attained by a electrophotographic printing apparatus comprising a paper conveyor path, a conveyor unit for conveying paper along the conveyor path, an image forming unit arranged on the paper conveyor path, for forming an electrostatic latent image on an image carrier, developing the electrostatic latent image by depositing a developer on the electrostatic latent image, and transferring the developer image to paper, a fixing unit arranged on the paper conveyor path, for fixing the transferred image on the paper by heat and pressure, and a controller for detecting overheating of the fixing unit and commanding the conveyor unit to stop conveyance of paper after confirming that no paper is present in the fixing unit.

Since paper is not left in the fixing unit of the electrophotographic printing apparatus when paper conveyance is stopped due to overheating of the fixing unit, this prevents paper in the apparatus from catching fire or being damaged by excessive heating.

Additional objects and advantages of the invention will be set forth in the description which follows, and in part will be obvious from the description, or may be learned by practice of the invention. The objects and advantages of the invention ma be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A laser printer according to an embodiment of the present invention will now be described below, with reference to FIGS. 1 to 3.

Figure 1:
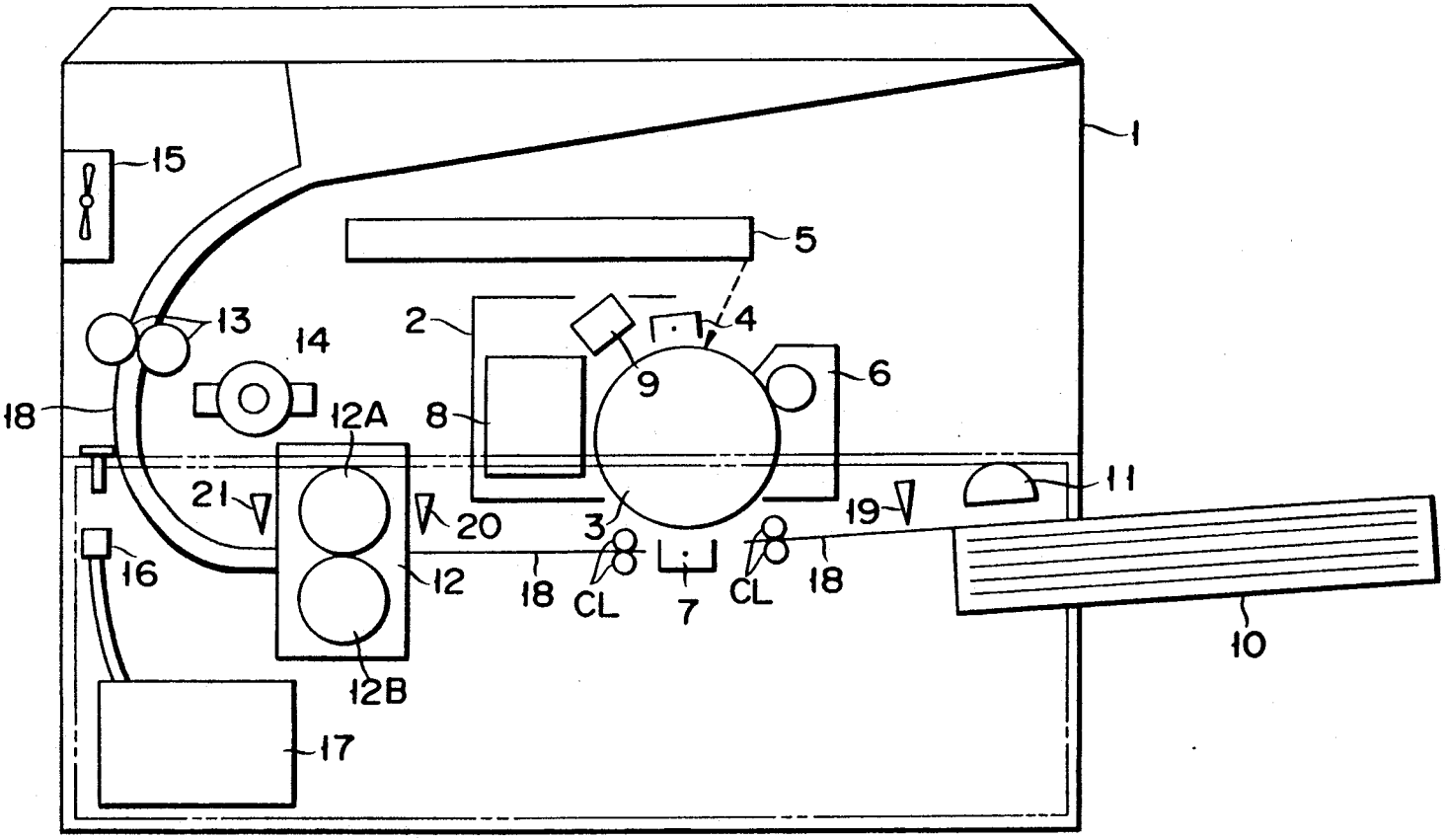
FIG. 1 is a schematic view showing the internal structure of a laser printer according to an embodiment of the present invention.

FIG. 1 shows the internal structure of the laser printer. The laser printer has a cabinet 1 having an upper portion which can be opened by pivoting, and a photosensitive unit 2 detachably mounted substantially on the center of the cabinet 1. The photosensitive unit 2 includes a photosensitive drum 3 having a surface of photoconductive materials and which rotates clockwise. A charger 4, a laser scanner unit 5, a developing unit 6, a transfer charger 7, a cleaning unit 8, and a discharge lamp 9 are arranged around the photosensitive drum 3 to perform a printing operation by an electrophotographic process.

The charger 4 uniformly charges the surface of the photosensitive drum 3, and the laser scanner unit 5 forms an electrostatic latent image on the drum surface by selective exposure using a laser beam radiated in correspondence with input image information. The developing unit 6 develops the electrostatic latent image formed on the drum surface by depositing toner on the image, and the transfer charger 7 charges a sheet of paper to transfer the toner image from the drum surface onto the paper by electrostatic attraction. The cleaning unit 8 removes toner remaining on the drum surface after transfer, and the discharge lamp 9 removes an unwanted electric charge therefrom so that the surface of the photosensitive body can be charged again.

The laser printer further comprises a paper feed unit 10, a pick-up roller 11, a fixing unit 12, conveyor rollers CL, paper discharge rollers 13, a conveyor motor 14, a fan 15, an interlock switch 16, a DC power source unit 17, a paper conveyor path 18, and paper sensors 19, 20, and 21. Sheets of paper stacked in the paper feed unit 10 are picked up one by one at a predetermined timing by the pick-up roller 11 and supplied to the transfer charger 7 through the conveyor path 18 by the conveyor rollers CL. The fixing unit 12 has heat and pressure rollers 12A and 12B for applying heat and pressure to the paper supplied from the transfer charger 7 by the conveyor rollers CL, and fixes the transferred toner image on the paper. The paper discharge rollers 13 convey the paper supplied from the fixing unit 12 to the upper surface of the cabinet 1. The fan 15 radiates internal heat outside the cabinet 1. The interlock switch 16 detects that the upper portion of the cabinet 1 is open, and cuts off power supply from the DC power source unit 17. The conveyor motor 14 rotates the photosensitive drum 3, the convey rollers CL, the paper discharge rollers 13, and the pick-up roller 11, thereby allowing paper to be conveyed along the conveyor path 18. The paper sensors 19, 20, and 21 are arranged near the pick-up roller 11 and at the entrance and exit of the fixing unit 12, to detect the presence of paper sequentially supplied from paper feed unit 10. It should be noted that the pick-up roller 11 does not pick up the next sheet of paper until the immediately preceding sheet of paper picked up from the paper feed unit 10 has been discharged.

Figure 2:
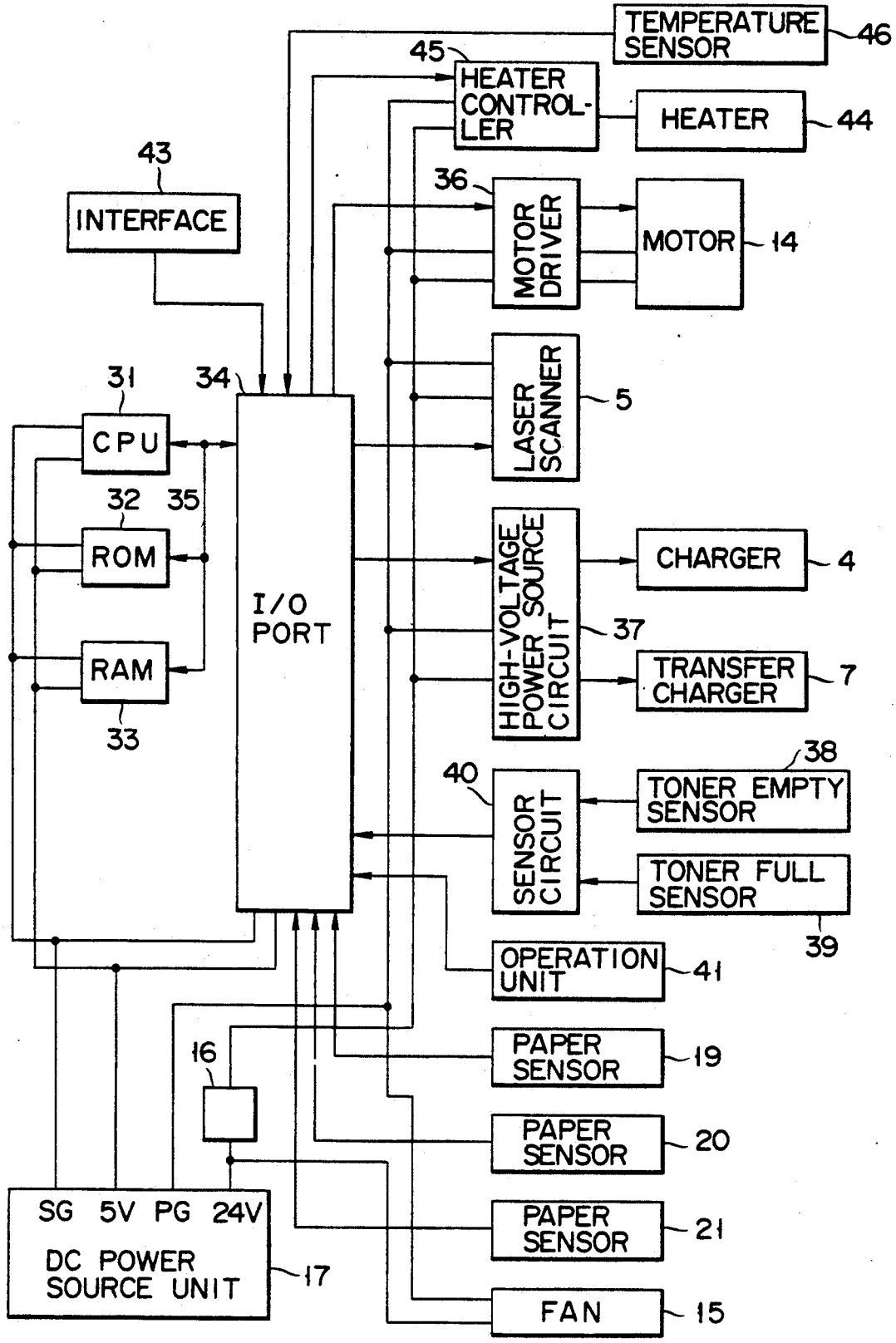
FIG. 2 is a block diagram showing a controller of the laser printer shown in FIG. 1.
Figure 3:
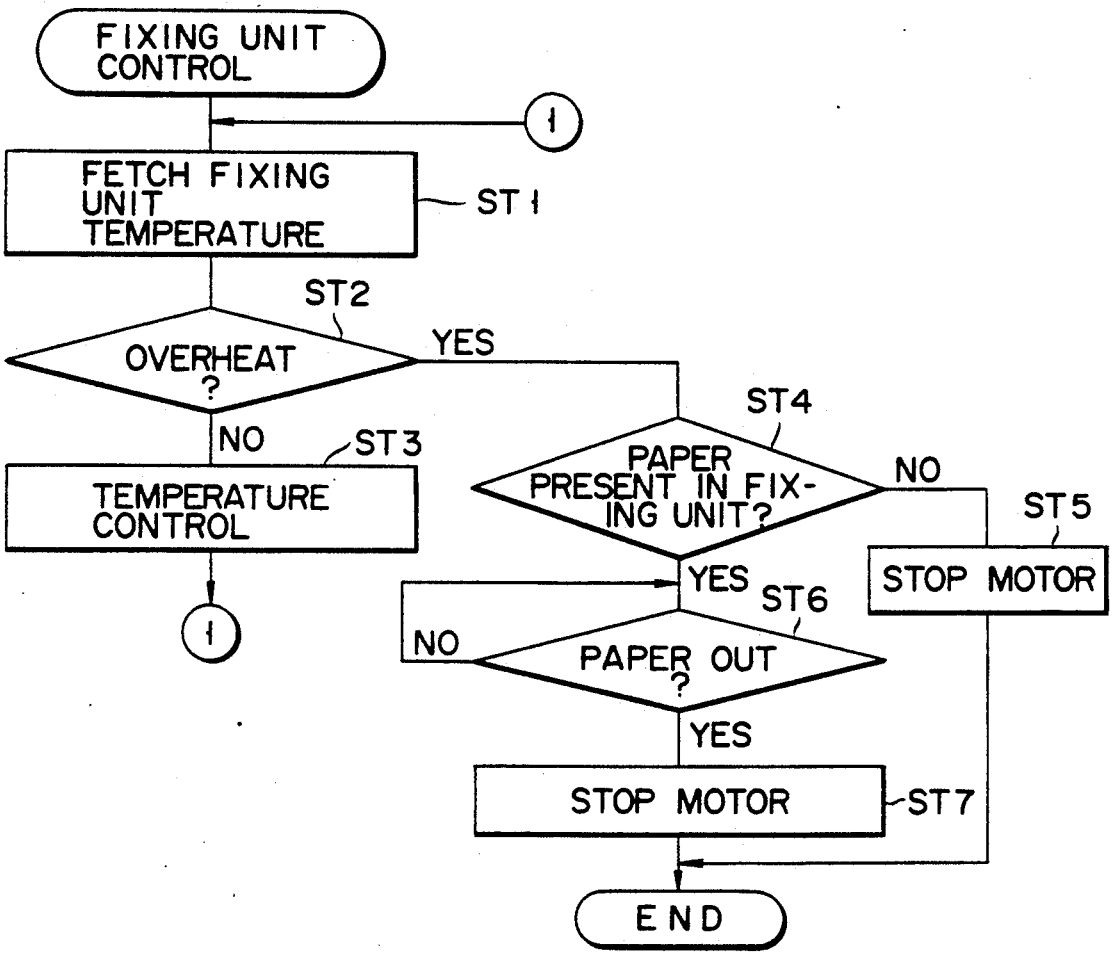
FIG. 3 is a flow chart explaining the operation of the controller shown in FIG. 2.

FIG. 2 shows the controller of the laser printer having the above arrangement. The controller comprises a CPU (Central Processing Unit) 31 for performing various data processing required to control a printing operation, a ROM (Read Only Memory) 32 for storing control programs of the CPU 31 and various data tables, a RAM (Random Access Memory) 33 for temporarily storing various I/O data of the CPU 31, including image information and various commands supplied from an external host computer, an I/O port 34 for connecting periphral circuits (to be described later) to the CPU 31, and a bus line 35 for connecting the CPU 31, the ROM 32, the RAM 33, and the I/O port 34.

The I/O port 34 is connected to the laser scanner unit 5, the paper sensors 19, 20, and 21, a motor driver 36, a high-voltage power source circuit 37, a sensor circuit 40, an operation unit 41, an interface 43, a heater controller 45, and a temperature sensor 46. The motor driver 36 drives the conveyor motor 14. The high-voltage power source circuit 37 supplies a high voltage to the charger 4 and the transfer charger 7. The sensor circuit 40 controls a toner-empty sensor 38 and a toner-full sensor 39 provided in the developing unit 6, and receives detection signals therefrom. The operation unit 41 is operated to input information required to control a printing operation. The interface 43 receives image information and various commands supplied from the external host computer. The interlock switch 16 is inserted in a power line for supplying power of 24V from the DC power source unit 17 to the laser scanner unit 5, the motor driver 36, and the high-voltage power source circuit 37, and cuts off power supply when the upper portion of the cabinet 1 is opened. The heater controller 45 is connected to a heater 44 provided in the heat roller 12 of the fixing unit 12 and controls the operation of the heater. The temperature sensor 46 measures the temperature of the fixing unit 12 heated by the heater 44. The CPU 31, the ROM 32, the RAM 33, and the I/O port operate under a +5-V power source voltage supplied from the DC power source unit 17. The paper sensor 20 is constituted by a photosensor for detecting the leading end of a sheet paper and a counter for holding the detection count, while the paper sensor 21 is constituted by a photosensor for detecting the trailing end of a sheet of paper and a counter for holding the detection count. The contents of the counters of the paper sensors 20 and 21 are cleared to "0" when the CPU 31 receives a printing start instruction from a host computer, and are incremented in response to detection signals from the photosensors.

A printing operation performed by the above laser printer will now be described.

When a printing operation begins, the photosensitive drum 3 is rotated clockwise and a sequence of processes are performed by the charger 4, the laser scanner unit 5, the developing unit 6, the transfer charger 7, the cleaning unit 8, and the discharge lamp 9, in that order. Specifically, after the charger 4 has uniformly charged the surface of the photosensitive drum, the charged surface is scanned and selectively exposed by a laser beam radiated from the laser scanner unit 5, in correspondence with input image information. When an electrostatic latent image is formed o the drum surface by the exposure process, the developing unit 6 supplies toner onto the drum surface. The toner adheres to the drum surface in correspondence with the electrostatic latent image formed thereon, thereby visualizing it as a toner image. The transfer charger 7 then charges a sheet of paper supplied from the paper feed unit 10, to transfer the toner image from the photosensitive drum surface onto the paper by electrostatic attraction. After transfer, the cleaning unit 8 removes toner remaining on the drum surface, and the discharge lamp 9 removes an unwanted electrical charge therefrom. Thereafter, the photosensitive drum 3 is reset in a chargeable state, and the paper bearing the transferred image has it fixed thereto by the fixing unit 12 and is discharged by the paper discharge rollers 13.

The above printing operation is at least once each time the CPU 31 receives the printing start instruction. In each printing operation, the CPU 31 performs the fixing control processing shown in FIG. 3. When this processing is started, the CPU 31 reads, in step ST1, the temperature of the fixing unit 12 as measured by the temperature sensor 46, and checks in step ST2 whether the measured temperature is at an overheat level much higher than a predetermined reference value. If the measured temperature has not reached overheat level, the CPU 31 adjusts, in step ST3, power supply to the heater 44 so as to set the temperature of the fixing unit 12 at the reference value, and executes ST1 again. If overheating of the fixing unit 12 is detected in step ST2, the CPU 31 checks the paper sensors 20 and 21 in step ST4 to confirm that no paper is present in the fixing unit 12. If the paper detection count of the paper sensor 20 coincides with that of the paper sensor 21, this indicates that no paper is present in the fixing unit 12. In this case, the CPU 31 immediately stops the conveyor motor 14 in step ST5, cuts off the power supply to the heater 44, and displays a warning indicating a malfunctioning of the fixing unit 12 on a display of the operation unit 41. Image formation and conveyance of paper are interrupted until maintenance is performed on the laser printer.

If the paper detection count of the paper sensor 20 is greater by one than that of the paper sensor 21, this indicates that paper is present in the fixing unit 12. In this case, the CPU 31 waits, in step ST6, until the paper passes through the fixing unit 12, and stops the conveyor motor 14 in step ST7 after the elapse of predetermined time period required to convey the paper to the outside of the laser printer. As in the previously-described case, image formation and conveyance of paper are interrupted until maintenance of the laser printer is performed.

In the above laser printer, a toner image on the photosensitive drum is transferred to paper supplied from the paper feed unit 10 to the transfer charger 7, and is then conveyed to the fixing unit 12. If the fixing unit 12 overheats, this is detected by means of the temperature sensor 46, and conveyance of paper is interrupted. If there is paper in the fixing unit 12 when the fixing unit is detected to be overheating, the conveyor motor 14 continues to operate at least until the paper is completely discharged, and is then stopped. In other words, conveyance of paper is continues at least while there is paper in the fixing unit 12. Therefore, even if power supply to the heater 44 cannot be controlled due to a failure of the heater controller 45, paper can be prevented from catching fire. Thus, since paper can not burn and adhere to the heater and pressure rollers, the time, effort, and expense required to carry out repair work is greatly reduced.

In the above embodiment, the CPU 31 constantly monitors the temperature of the fixing unit 12 by way of the temperature sensor 46. However, an overheating detector for detecting overheat of the fixing unit 12 can be provided independent of the CPU 31 so that the CPU 31 checks in accordance with a detection signal from the detector whether paper is present in the fixing unit 12. If, in this case, a reference voltage generator which generates an output voltage corresponding to the overheat temperature of the fixing unit 12 is provided in the overheat detector so as to compare the output voltage from the temperature sensor 46 with that from the reference voltage generator, an overheat detection signal can be obtained when the output voltage from the temperature sensor 46 exceeds that from the reference voltage generator.

In the fixing control processing of this embodiment, paper is conveyed to the outside of the printer if the fixing unit 12 is detected to be overheating. Conveyance of paper then stops when paper is removed from the fixing unit 12. In addition, a branch path may be formed from the paper conveyor path 18 to guide paper removed from the fixing unit.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrographic printing apparatus comprising:

a paper conveyor path;

an image carrier arranged on said paper conveyor path;

conveyor means for conveying paper along said conveyor path;

image forming means including means for forming an electrostatic latent image on an image carrier, means for developing the electrostatic latent image by depositing a developer on the electrostatic latent image, and means for transferring the developer image onto paper;

fixing means, arranged on said paper conveyor path, for fixing the transferred image on the paper by heat and pressure, said fixing means having an entrance and an exit; and control means including means for detecting overheating of said fixing means, and means for commanding said conveyor means to stop conveyance of paper after confirming that no paper is present in said fixing means;

said control means further including:

a first paper sensor means, arranged at the entrance of said fixing means, and including means for detecting a leading end of paper and for counting the number of times the leading end of paper is detected;

a second paper sensor means, arranged at the exit of said fixing means, and including means for detecting a trailing end of paper and means for counting the number of times the trailing end of paper is detected; and detecting means responsive to the counts of said first and second paper sensor means for detecting a presence of paper in said fixing means from a difference between the counts of said first and second paper sensor means.

2. An apparatus according to claim 1, wherein said control means further comprises paper discharging means for commanding said conveyor means to convey paper detected by said control means to be present in the fixing means in an overheated state, to outside of said fixing means, and for stopping further conveyance of paper.

3. An apparatus according to claim 2, wherein said control means further comprises:

temperature sensor means for measuring the temperature of said fixing means; and means for detecting when the temperature measured by said temperature sensor means has reached an overheat level.

4. An apparatus according to claim 3, wherein said paper discharging means includes means for guiding paper conveyed to outside of said fixing means to a predetermined position before conveyance of paper is stopped.

5. An apparatus according to claim 4, wherein said predetermined position is on the outside of said electrophotographic printing apparatus.

6. An apparatus according to claim 1, wherein said control means further comprises alarm means for indicating that conveyance of paper has been stopped due to overheating of said fixing means.

* * * * *